United States Patent [19]

Freed

[11] Patent Number: 4,978,319

[45] Date of Patent: Dec. 18, 1990

[54] STRIP MOUNTED ADAPTER SUPPORTING A LAMP AND FEATURING CONDUCTIVE SPADE ENGAGING APPARATUS

[75] Inventor: Herbert D. Freed, Miami Beach, Fla.

[73] Assignee: Emmanel Corp., San Antonio, Tex.

[21] Appl. No.: 355,639

[22] Filed: May 23, 1989

[51] Int. Cl.[5] ..... H01R 13/00
[52] U.S. Cl. ..... 439/638
[58] Field of Search ..... 439/638

[56] References Cited

U.S. PATENT DOCUMENTS

| | | | |
|---|---|---|---|
| 744,387 | 1/1903 | O'Brien | 362/217 |
| 2,716,739 | 4/1955 | Lemmers | 339/52 |
| 4,158,221 | 2/1979 | Agabekov | 356/219 |
| 4,418,973 | 1/1983 | Smetana et al. | 339/31 L |
| 4,482,944 | 9/1984 | Roossine et al. | 362/418 |
| 4,521,838 | 2/1985 | Agabekov | 362/219 |
| 4,569,568 | 2/1986 | Agabekov | 439/638 |
| 4,723,199 | 6/1988 | Freed et al. | 362/219 |

FOREIGN PATENT DOCUMENTS

| | | |
|---|---|---|
| 652537 | 4/1985 | Switzerland . |
| 654094 | 9/1986 | Switzerland . |

*Primary Examiner*—Joseph H. McGlynn
*Attorney, Agent, or Firm*—Gunn, Lee & Miller

[57] ABSTRACT

The present disclosure is directed to a removable adapter for installing a lamp on a strip. The strip is constructed with uniformly spaced, identical current delivering electrodes, adjacent electrodes being of opposite polarity. The present adapter includes end located enlargements wherein each enlargement enclosures a slot, the slot incorporating a leaf spring which resiliently contacts against a spade inserted thereinto. This assures quality electrical contact. Moreover, the leaf springs connect with suitable conductors which in turn extend to a socket means integrally constructed within one of the enlargements. The socket means is provided with first and second openings thereinto, to permit contacts on the lamp deployed in accordance with an industry standard to be inserted for mounting the lamp.

11 Claims, 1 Drawing Sheet

STRIP MOUNTED ADAPTER SUPPORTING A LAMP AND FEATURING CONDUCTIVE SPADE ENGAGING APPARATUS

BACKGROUND OF THE DISCLOSURE

The present disclosure is directed to an improved adapter to be mounted on an elongate strip for strip lighting purposes. The present adapter has a function which will be more readily understood on a description of the supporting structure. Briefly, it is intended for use with a support structure which will be defined as a strip base. The strip base is constructed of generally flat stock, has an indefinite length, and is formed with a protective plastic face. It supports spaced, upstanding connective spades, that term being applied to the protruding electrical current delivering metal tabs which are uniformly spaced so that current is provided for operation of lamps supported on the strip. The strip is normally quite long, and hence will support many lamps. As will be understood, each lamp normally involves first and second end located terminals so that the spades have alternating polarity. That is, an even number of spades is arranged along the strip, and the spades deliver electrical current for customary operation of lamps having end located current-drawing terminals. By this arrangement, a multitude of lamps is normally installed on the strip. The lamps are normally installed by making contact. The contact is accomplished between adjacent spades. The spades, arranged in pairs, thus are utilized to support conventional and well known lamps for providing strip illumination for decorative purposes, and the like.

The present disclosure however is an improved adapter which particularly enables use of a brighter lamp. There is a certain requisite lighting level accomplished with conventional incandescent or fluorescent bulbs in strip lighting. To achieve even better lighting, halogen lamps are installed. Halogen lamps however differ in that they have different mounting for the electrical contacts. A halogen lamp is ordinarily constructed with two pins or wires which extend from the same end of the envelope which comprises the lamp. In contrast with incandescent or fluorescent construction, the halogen bulb does not have two spaced apart, current consuming electrodes. Rather, the two pin connectors or contacts extend from a common end which makes it somewhat difficult to connect. In other words, since the pins extend from the same end of the lamp, they must connect at spades which straddle the lamp when installed on the strip.

Such a strip as described herein is set forth better in application Ser. No. 198,083 which was filed on May 24, 1988, and which is the property of the common assignee of the present disclosure. Moreover, representative earlier patents of strips with lamp adapters are set forth as for example in U.S. Pat. No. 4,569,568 which issued on Feb. 11, 1986. The adapter shown in the latter disclosure and those adapters which are typical of that genre set out supporting structures which are installed in a different kind of spade supporting, power furnishing strip. The present apparatus, however, adds features which make it much easier to mount and demount. In other words, the adapter of this disclosure is mounted on spades which are more readily engaged and disengaged, and in that sense, represent a structure which is more easily handled. For instance, the strip of the present disclosure can support a string of many halogen lamps, all using the present adapter which can be installed or removed or selectively serviced with high speed. Simple hand manipulation will accomplish servicing.

Another useful feature of the present apparatus is the incorporation of spring or snap loading springs for locking on the current providing spades. This provides a sure frictional grip, and more importantly, adds sufficient spring loaded engagement that current flow from the current conducting spade into the lamp is accomplished with a minimum of contact resistance. The contact area is completely sheltered by a surrounding non-conductive plastic housing for safety sake. Another valuable feature of the present disclosure is the utilization of a hidden and completely enclosed or recessed set of conductors. That is, the conductors are never exposed on the exterior. Beginning with recessed contacts which contact the spades, the conductors are all completely enclosed and therefore accidental contact is prevented. Another valuable feature is the incorporation of a two-part construction wherein the body of the adapter is made of a described high impact electrical insulating plastic material, and the formation of a polished surface thereon by means of a surface bonded layer which enhances reflectivity. The surface layer provides a surface which reflects and yet diffuses the light so that sharp point lighting is distributed when the halogen lamp is turned on. This is valuable to provide more uniform lighting from the strip. This strip is ordinarily covered with a translucent cover which is intended to readily transmit light therethrough and which is translucent to assure avoidance of spot illumination so that the user will not be able to see the filaments of the various lamps supported by the strip.

The present structure is therefore summarized as a single piece construction of a demountable adapter. It is adapted to be fastened on a pair of upstanding similarly constructed parallel spades which are located at a fixed distance from one another. The spades provide positive and negative current conducting terminals. The adapter has a single piece construction and thus includes spade receiving terminals at opposite ends. At both ends, there is an enlargement which has an internal cavity, and a leaf spring is located therein to bear against the spade inserted into the cavity. The leaf spring is formed of conductive metal to assure a low resistance serial conducting contact with the current providing spades. Moreover, the two terminals connect with two conductors. They extend to a socket which is integrally constructed within one end of the structure, and the socket has a pair of openings to receive current conducting pins from a lamp. The preferred and known form of lamp is a halogen lamp which has a glass envelope with a pair of pins at one end, and these pins are located in accordance with an industry standard. The adapter is formed of a high impact plastic material which is an insulator. It has a surface which is relatively reflective, and the surface is optionally coated. The lamp is located between ends of the adapter, and the adapter, between the ends, is constructed so that there are three sides exposed and facing the lamp. The three sides describe a truncated "V" with two upstanding sides at divergent positions, inscribing at an angle of about 60° to 90° therebetween. This serves as a type of light reflector. These surfaces are optionally coated with an adherent or bonded layer which assures a relatively white body which is polished to a measure, but which is also slightly irregular to assure substantial light reflection with a measure of diffusion to thereby avoid spots of light from the strip fixture.

IN THE DRAWINGS

The drawings of the present disclosure are representative and set out in some detail a preferred embodiment of the apparatus of the present disclosure, and the drawings are subject variation in accordance with those objectives accomplished of one of average skill in the art. The drawings therefore include:

The single drawing is a longitudinal sectional view through the adapter of the present disclosure showing a halogen lamp mounted therein and further showing the mounting of the adapter on current providing spades supported by an elongate strip, all to be enclosed within a translucent housing for providing illumination.

DETAILED DESCRIPTION OF THE PREFERRED EMBODIMENT

Figure 1:
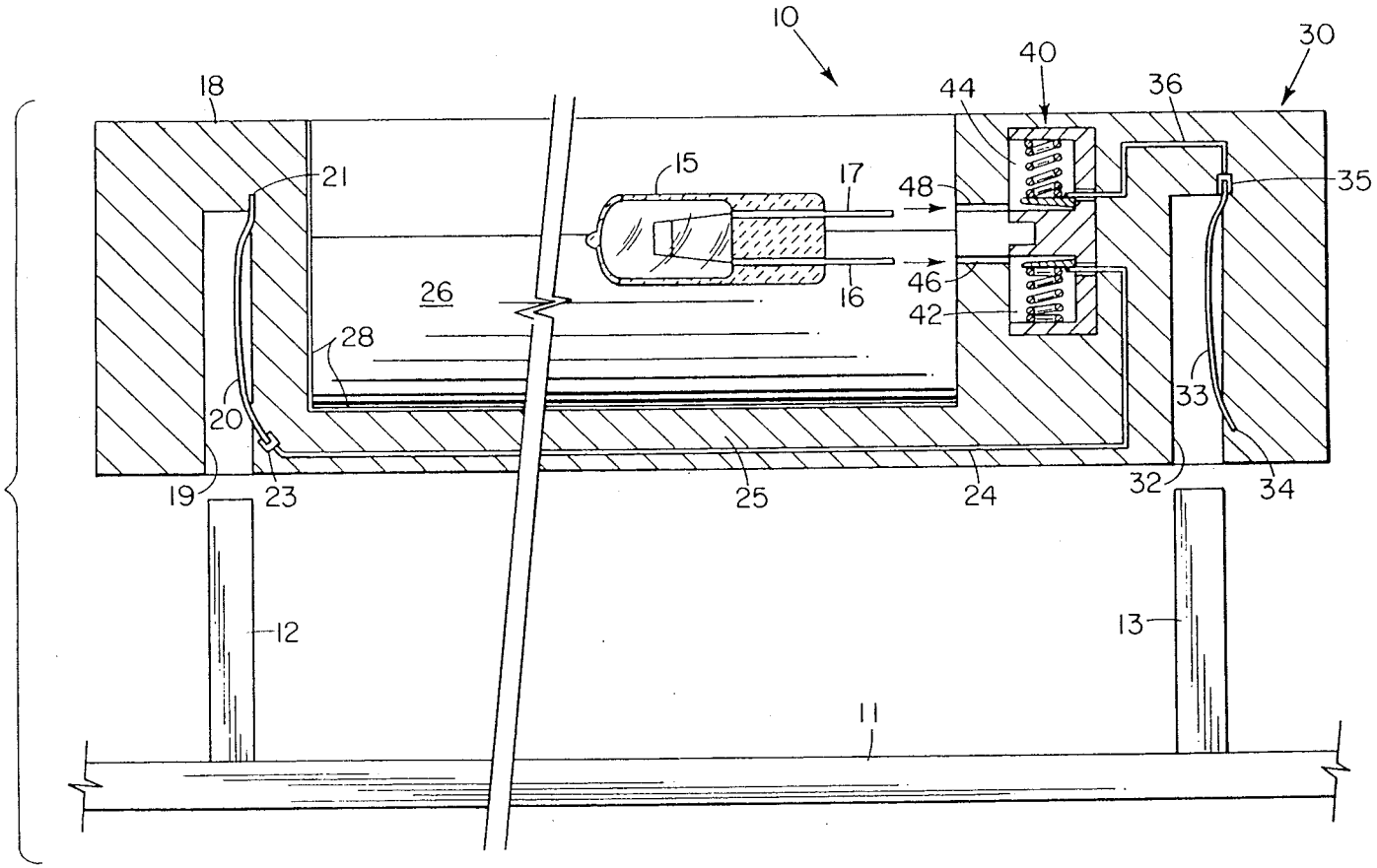

Attention is now directed to FIG. 1 of the drawings where the numeral 10 identifies an adapter in accordance with the teachings of this disclosure. This adapter is especially constructed to be installed on a lighting strip of the sort best set forth in application Ser. No. 198,083 which was filed on May 24, 1988, and wherein the strip is constructed as an elongate base member 11 and supports spaced current providing terminals 12 and 13. The terminals are connected with conductors (not shown) submerged in the strip 11. The spades 12 and 13 have a common height and thickness and are spaced uniformly along the strip 11 in pairs. For ease of identification, the spade 12 will be described as the positive terminal or the hot terminal, while the remaining spade 13 will be the ground terminal. The terminals have a specified and uniform width and spacing between terminals or spades 12 and 13; this permits the adapter 10 to be manufactured to a common length for installation.

The terminals 12 and 13 have a common height of about ½ inch or so, and have a common width, typically in the range of about ¼ inch. They are relatively thick and are formed of metal so that they can serve as current conducting terminals. They are of opposite polarity as a result of the connection accomplished in the strip 11 which is a thin, low profile structure which can be mounted (as for instance, with bolts, screws, staples and the like) on a wall or other surface. A translucent cover is placed over the strip after installation, and the cover is used to emit diffused light into the immediate vicinity. All of this is again best described in the referenced co-pending application.

The adapter 10 of the present disclosure is particularly adapted to install a halogen lamp 15 which is constructed in accordance with an industry standard, having a specified size glass envelope and which lamp emits light, generally in all directions around the envelope. For ease of installation, the lamp additionally has a pair of pins 16 and 17 which are constructed again in accordance with the industry standard so that they have a common length, stiffness, and spacing. This permits the lamp to be removed and replaced interchangeably. Moreover, the lamp 15 may ultimately burn out, and when that occurs, it can be discarded by the simple expedient act of removal and subsequent insertion of a replacement lamp.

The lamp 15 emits light of a known spectrum at relatively high intensity. Since the light emission is omnidirectional, it is desirable to reflect a substantial portion of that light out one side of the adapter. To this end, a reflective surface will be described with the adapter. The adapter is preferably formed of single piece construction. It is formed of a high impact electrically insulative material. It is a material which can tolerate extended use with exposure to high temperatures. Moreover, it is formed with a surface which is coated so that light reflectivity is accomplished as will be set forth.

The adapter 10 includes an enlargement 18 at one end of the structure. It has the form of a rectangular housing which is constructed to surround the spade 12. The housing has a slot formed in it. The slot 19 is sized to fit snugly around the spade 12 without interference. Thus, the slot is dimensionally slightly larger than the spade 12. This permits the enlargement 18 to be finger installed by simply placing it over the spade 12. The spade is guided into the slot 19 and is fastened on the spade for installation. The slot would otherwise slide free of the spade were it not for the incorporation of the leaf spring 20. The leaf spring 20 has two ends, each end being anchored. The upper end 21 is anchored by embedment in the body of the plastic body making up the enlargement 18. The enlargement is approximately rectangular in cross-section. It stands somewhat taller than the spade to provide substantial body to the structure. The slot 19 extends upwardly to the embedded end 21 of the spring. This assures that the spring is located where it is required, and assures fixing the spring so that it bows into the slot to obtain frictional engagement with the spade 12.

The opposite end of the leaf spring 20 is also embedded at 22. The embedded end 22 is fastened so that the leaf spring tends to bow slightly. This assures that the midpoint of the leaf spring frictionally engages the current conducting spade 12. In addition to that, the spring is fastened to a connector 23 which is cast integrally into the body of the enlargement 18. The fastener 23 is electrically connected to the spring 20. The fastener 23 is fabricated within the body of the enlargement at the time of casting. The fastener 23 supports and connects to the end of an electrical conductor 24. It is fairly long, extending along the length of the structure and on a route which will be described.

The reflective fixture includes a backing portion 25. The portion 25 is of relative thickness to assure stiffness for the device and to also assure structural or dimensional stability. The backing member 25, when viewed from the direction of the lamp 15 is somewhat wider than the lamp 15. The lamp 15 is positioned above the backing member 25 and is sized so that the lamp is engaged in a type of trough when installed. There must be sufficient clearance in length to permit the lamp 15 to be plugged and unplugged above the backing member 25. The lamp provides illumination which radiates in substantially all directions. A portion of this light is reflected back to a more useful direction by means of a reflective side wall 26. The side wall 26 cooperates with a facing side wall (not shown), the two side walls providing symmetry in construction so that they bracket or partially enclose the lamp 15.

The side walls preferably diverge from one another to inscribe an approximate 60° angle therebetween. This angle is selected to assure that a substantial portion of the light which impinges on the two side walls is reflected back into the useful area when the lamp is installed on the strip 11. Thus, the side walls 26 are divergent from one another and inscribe an angle in the range of about 60° to 90°. They are symmetrically positioned so that reflection is obtained. Moreover, they have sufficient height that the lamp is surrounded on approximately 180° of its circumference to assure ample reflection.

The enlargement 18 and the adjacent side walls 26 are integrally constructed to define a type of trough. The surfaces of the trough which face the lamp 15 are coated with a coating material 28. The coating material 28 is preferably a surface finish material enabling proper reflection. This surface coating material can be constructed integrally with casting of the adapter 10. Alternately, it can be applied with a suitable adhesive after fabrication of the body. In either case, the coating material is preferably white and is polished to a measure but has a certain degree of surface roughness so that the light is reflective with some random diffusion. The surface coating 28 is shown on the enlargement 18 which confronts the bulb 15, and it is extended along the full length of both the side walls 26. In addition, it extends along the backing member 25.

At the opposite end of the apparatus, an enlargement 30 is also illustrated. It is thicker than the enlargement 18 shown at the left, but the two have a common width and common height. The enlargement 30 is thicker to enclose the conductors and the socket 40. In particular, the enlargement which fully surrounds the socket 40 has an internal chamber 42 which is provided for the first electrical contact 16. A similar chamber 44 is included in the socket 40. The pins 16 and 17 insert directly into a pair of aligned holes at 46 and 48. These guide the two pins into the chambers 42 and 44. The chambers 42 and 44 each receive coil springs bearing against suitable contact plates for pinching on or clamping against the pin contacts 16 and 17. That is, electrical contact is assured whereby the wires 24 and 36 are inserted at the backside of the socket 40 while the pins 16 and 17 insert at the front side, and contact is assured in operation of the two coil springs. The coil springs bear against the pins 16 and 17 and the current conductors 24 and 36 to assure proper contact for illumination. The enlargement has a similar slot and leaf spring to clamp on the spade.

The present structure thus comprises an adapter of fixed length. It is constructed to fasten on the spades 12 and 13 which are separated by a fixed length also. Moreover, the fixed length permits multiple use of the adapter 10. In a multiple installation, several such fixtures 10 can be installed and each can receive its own lamp 15. The lamps are installed simply by hand insertion of the pins 16 and 17 into the appropriate holes. They extend into the socket assembly 40 which is typically a bought item. That is cast in the enlargement 30 so that easy connection can be obtained without difficulty in making electrical connection.

While the foregoing describes the preferred embodiment, the scope thereof is determined by the claims which follow.

I claim:

1. In an adapter for lamp installation on a flat stock strip mounting with spades projecting generally perpendicular therefrom, the adapter comprising:

(a) an elongate body having first and second enlargements spaced along said body wherein said enlargements are:

(1) spaced apart sufficiently to receive a lamp there-between;

(2) each equipped with a receiving slot on a common face thereof for receiving the spades of the flat stock strip;

(3) of sufficient height and width to enable the slot therein to encompass the spade when the spade is inserted into the slot;

(b) current contacting means in each of said slots for contacting the spades when inserted, wherein said current contacting means are arranged to provide current flow between the spades for illumination of the lamp installed in the fixture;

(c) socket means constructed with a pair of openings therein for receiving a pair of current conducting pins on the lamp which are deployed in accordance with an industry standard, and wherein said socket means is constructed with one of said enlargements;

(d) said socket means being positioned in said enlargement to locate the lamp between said enlargements; and (e) backing means extending between said enlargements and comprising a portion of said body to receive said lamp installed between said enlargements, and wherein said backing means defines the spacing of said enlargements to assure mounting of said enlargements on said spades, and wherein said backing means positions the lamp on installation to provide illumination in a desired direction.

2. The apparatus of claim 1 including first and second conductors extending from said current contacting means to said socket means to provide a complete electrical circuit for operation of the lamp.

3. The apparatus of claim 1 wherein said socket means includes first and second enclosed cavities therein and including resilient means in each of said cavities for providing resiliently urged contact with the pin contacts of the lamp arranged in an industrially accepted standard for the lamp.

4. The apparatus of claim 1 wherein said backing means is immediately adjacent to first and second spaced side walls, and wherein said backing means and first and second spaced side walls present surfaces to the installed lamp, causing reflection of light omnidirectionally emitted from the lamp in the desired direction.

5. The apparatus of claim 4 wherein said current contacting means within said slots include resiliently loaded current conducting contacts urged into contact with said spades only on insertion of said spades into said slots.

6. The apparatus of claim 1 including left and right divergent side walls along the length of said body, wherein said side walls are provided with a reflective surface to reflect with diffusion light emitted from the lamp.

7. The apparatus of claim 6 wherein said body is formed of electrically insulating material.

8. The apparatus of claim 7 including first and second conductive metal springs in said enlargements, each having a metal contacting region for electrical contact.

9. The apparatus of claim 8 wherein each of said metal springs includes an embedded terminal connected to a conductive lead to said socket means.

10. The apparatus of claim 9 wherein said metal springs are mounted by embedment in said enlargements, and further including means aligning said metal springs for sliding contact with the spades.

11. In an adapter lamp installation on a strip mounting such adapter, the adapter comprising:

(a) an elongate body having first and second enlargements spaced along said body wherein said enlargements are:

(1) spaced apart sufficiently to receive a lamp there-between;

(2) each equipped with a spade receiving slot on a common face thereof;

(3) of sufficient height and width to enable the slot therein to encompass the spade when the spade is inserted into the slot;

(4) left and right divergent side walls along the length of said body, wherein said side walls are provided with a reflective surface to reflect with diffusion light emitted from the lamp;

(5) said body is formed of electrically insulating material;

(6) including first and second conductive metal springs in said enlargements, each having a metal contacting region for electrical contact; wherein each of said metal springs includes an embedded terminal connected to a conductive lead to said socket means wherein said metal springs are mounted by embedment in said enlargements, and further including means aligning said metal springs for sliding contact with the spades;

(b) current contacting means in each of said slots for contacting the spades when inserted, wherein said current contacting means are arranged to provide current flow between the spades for illumination of the lamp installed in the fixture including first and second conductors extending from said current contacting means to said socket means to provide a complete electrical circuit for operation of the lamp;

(c) socket means constructed with a pair of openings therein for receiving a pair of current conducting pins on the lamp which are deployed in accordance with an industry standard, and wherein said socket means is constructed with one of said enlargements wherein said socket means includes first and second enclosed cavities therein and including resilient means in each of said cavities for providing resiliently urged contact with the pin contacts of the lamp arranged in an industrially accepted standard for the lamp;

(d) said socket means being positioned in said enlargement to locate the lamp between said enlargements; and (e) backing means extending between said enlargements and comprising a portion of said body to receive said lamp installed between said enlargements, and wherein said backing means defines the spacing of said enlargements to assure mounting of said enlargements on said spades, and wherein said backing means positions the lamp on installation to provide illumination a desired direction;

wherein said backing means is immediately adjacent to first and second spaced side walls, and wherein said backing means and first and second spaced side walls present surfaces to the installed lamp, causing reflection of light omnidirectionally emitted from the lamp in the desired direction; wherein said current contacting means within said slots include resiliently loaded current conducting contacts urged into contact with said spades only on insertion of said spades into said slots.

* * * * *